United States Patent [19]

Westwick et al.

[11] Patent Number: 5,045,773

[45] Date of Patent: Sep. 3, 1991

[54] CURRENT SOURCE CIRCUIT WITH CONSTANT OUTPUT

[75] Inventors: Alan L. Westwick, Austin; Roger A. Whatley, Georgetown, both of Tex.

[73] Assignee: Motorola, Inc., Schaumburg, Ill.

[21] Appl. No.: 590,859

[22] Filed: Oct. 1, 1990

[51] Int. Cl.[5] ..... G05F 3/28

[52] U.S. Cl. ..... 323/316; 323/315; 307/296.7

[58] Field of Search ..... 323/312, 313, 314, 315, 323/316; 307/296.1, 296.6, 296.7

[56] References Cited

U.S. PATENT DOCUMENTS

| | | | |
|---|---|---|---|
| 4,342,926 | 8/1982 | Whatley | 323/315 |
| 4,450,366 | 5/1984 | Malhi et al. | 307/296.6 |
| 4,450,367 | 5/1984 | Whatley | 323/315 |
| 4,618,816 | 10/1986 | Monticelli | 323/316 |
| 4,647,841 | 3/1987 | Miller | 323/316 |
| 4,792,750 | 12/1988 | Yan | 323/315 |
| 4,855,618 | 8/1989 | Brokaw | 307/296.6 |
| 4,890,052 | 12/1989 | Hellums | 323/315 |

*Primary Examiner*—Peter S. Wong
*Attorney, Agent, or Firm*—Joe E. Barbee

[57] ABSTRACT

A current source circuit providing a constant output for wide variations in supply voltages is achieved by creating a constant reference current by reflecting the difference in the base to emitter voltage of two bipolar transistors across a resistor. A first current mirror creates an equal current which flows through two diode connected transistors that produce an output voltage proportional to the current flowing through them. This current also flows through a second current mirror which creates an equal current to flow to a feedback connection. The feedback connection adjusts the base voltage of the two bipolar transistors until a current equal to the reference current flows in a third current mirror. The current flowing in this third current mirror is also applied to the feedback connection to insure that all currents remain equal thereby insuring the output remains constant.

17 Claims, 1 Drawing Sheet

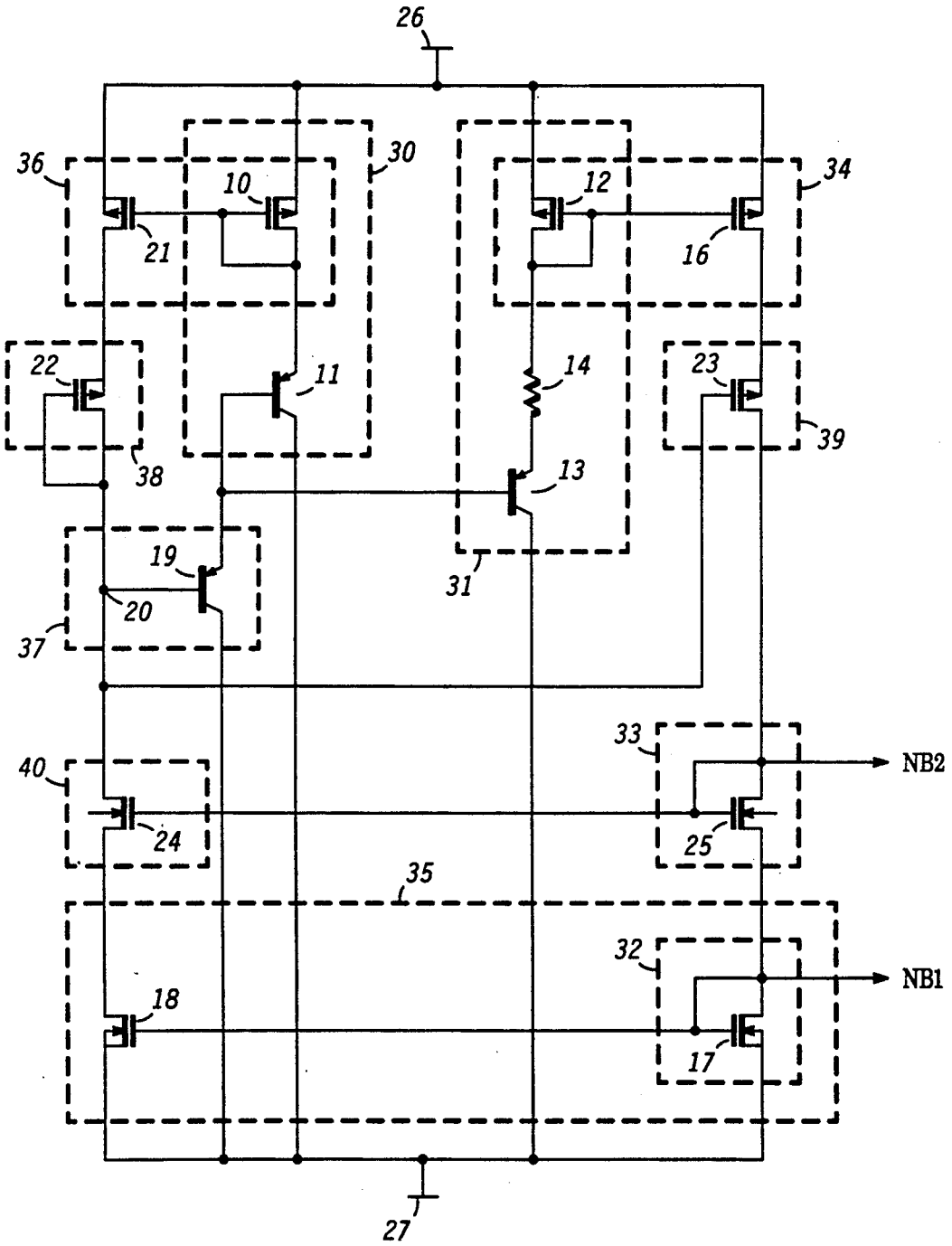
26
36
30
34
10
12
21
16
22
11
14
23
39
38
13
19
31
20
37
33
NB2
40
24
25
35
32
NB1
18
17
27

CURRENT SOURCE CIRCUIT WITH CONSTANT OUTPUT

BACKGROUND OF THE INVENTION

The present invention relates, in general to reference circuits, and more particularly, to a semiconductor current source circuit which minimizes output errors for a wide range of supply voltage variations.

Current source circuits which utilize a difference in base to emitter voltages between transistors as a means to develop a constant reference current were well known to the semiconductor industry. Methods used to implement the previous current source circuits resulted in circuits with several transistors stacked between the circuit's supply voltages. The voltage drop associated with the stacked transistors added together and limited the range of voltages over which the supply voltage could vary and yet have the current source continue to produce a desired current. Normally, those stacked transistors also had a body effect voltage which increased the transistor's gate to source voltage and further reduced the circuit's operating range. Generally, the electrical characteristics of those transistors were matched by using long channel transistors because the long channels reduced the effect of process variations on the channel length. However, long channels also increased the transistor's gate to source voltage thereby reducing the current source circuit's operating range even further. Accordingly, it would be desirable to have a current source circuit with fewer stacked devices and with devices having lower voltage drops thereby increasing the current source circuit's useful operating range by operating at lower supply voltages and minimizing the resulting output errors.

SUMMARY OF THE INVENTION

The objects and advantages of the present invention are achieved by creating a constant reference current by reflecting the difference in the base to emitter voltage of two bipolar transistors across a resistor. A first current mirror creates an equal current which flows through two diode connected transistors that produce an output voltage proportional to the current flowing through them. The current from the first current mirror also flows through a second current mirror which creates an equal current to flow to a feedback connection. The feedback connection adjusts the base voltage of the two bipolar transistors until a current equal to the reference current flows in a third current mirror. The current flowing in this third current mirror is also applied to the feedback connection to insure that all currents remain equal thereby insuring the output remains constant.

BRIEF DESCRIPTION OF THE DRAWINGS

The sole Figure is a schematic representation of a current source circuit in accordance with the present invention.

DETAILED DESCRIPTION OF THE DRAWINGS

The increasing demand for highly accurate semiconductor voltage conversion circuits and other analog devices has increased the need for current source circuits that supply a constant predetermined current as the supply voltage varies.

The present invention provides a circuit for producing a predetermined reference current that is constant for a wide range of supply voltages. The supply voltage tolerance ranges from as low as 3.7 volts to the upper limit permitted by the process and is achieved from the limited use of stacked transistors, from the use of transistors with low body effect voltages and corresponding low gate to source voltages, and also from the use of feedback to compensate for unequal currents. The influence of body effect voltages on the transistor's gate to source voltage is minimized by insuring the body is at the same potential as the transistor's source electrode. A difference between the base to emitter voltage of two bipolar transistors is utilized to develop a current through a resistance. A current mirror causes an equal current to flow in transistors that have gate to source voltages that are proportional to the current flowing in the transistor thereby developing voltages that are proportional to the developed reference current. These voltages can be applied to transistors in other circuits for reproducing the reference current.

While the invention is described with specific preferred embodiments, it is evident that many alternatives and variations will be apparent to those skilled in the semiconductor art. More specifically the invention has been described for a particular N-well CMOS process, although the method is directly applicable to P-well as well as other CMOS and other processes.

The sole Figure is a schematic representation of a current source circuit which comprises reference voltage section 30, reference current section 31, current mirror 34, unity gain buffer 39, current mirror 35, bias voltage section 32, bias voltage section 33, unity gain buffer 40, feedback section 37, level translator 38, and current mirror 36.

Reference voltage section 30 comprises diode connected transistor 10 which has a source electrode connected to supply voltage 26, and a drain and gate electrode connected to an emitter electrode of bipolar transistor 11. Bipolar transistor 11 also has a collector electrode connected to supply voltage 27. Reference current section 31 comprises diode connected transistor 12 which has a source electrode connected to supply voltage 26, and a gate and drain electrode connected to one terminal of resistance element 14. Bipolar transistor 13 has an emitter electrode connected to a second terminal of resistance element 14, a collector electrode connected to supply voltage 27, and a base electrode connected to a base electrode of bipolar transistor 11. Reference voltage section 30 and reference current section 31 function together to create a predetermined current flow through resistance 14 that is constant during supply voltage variations. Summing the voltages in the loop created by transistors 10, 11, 12, 13, and resistance 14 shows the voltage across resistance 14 is equal to a gate to source voltage of transistor 10 plus a base to emitter voltage of transistor 11 minus a base to emitter voltage of transistor 13 minus a gate to source voltage of transistor 12. The base to emitter voltage or gate to source voltage of each transistor is proportional to the current density in the respective transistor. The current density in any of the transistors can be forced to be unequal to the current density in the other transistors thereby creating a gate to source or a base to emitter voltage that does not equal the other base to emitter or gate to source voltage. In the case of unequal base to emitter voltages, the difference in the base to emitter voltages (delta $V_{BE}$) of the two transistors is developed across resistance 14 and a reference current is induced to flow through resistance 14. The reference current value can be set to a desired value by choosing a value for resistance 14 so that the reference current is equal to the delta $V_{BE}$ voltage divided by resistance 14.

In the preferred embodiment, transistors 10 and 12 are matched transistors with equal lengths and widths. Conversely, transistors 11 and 13 are formed to have unequal current densities thereby creating a voltage across resistance 14 that is the difference between the two base to emitter voltages or a delta $V_{BE}$ voltage. The unequal current density is achieved by forming the emitter of transistor 13 to be thirty-five times the size of the emitter of transistor 11.

The value of resistive element 14 as well as the value of the delta $V_{BE}$ voltage vary with temperature. The delta $V_{BE}$ voltage varies at a rate of 3300 parts per million per degree centigrade while the resistive element variation depends on the material. Since the reference current (I), which flows through transistor 12, is determined by voltage (delta $V_{BE}$ voltage) divided by the resistive element(R), the effect of temperature variations from each of the two sources tend to cancel ($I = -$delta $V_{BE}/R$). Therefore, temperature variations on the current can be minimized by choosing a resistive material with a temperature variation that is the same as the temperature variation of the delta $V_{BE}$ voltage. Multiple materials with different temperature variations can be combined to obtain the desired temperature variation for resistive element 14.

Reference voltage section 30 and reference current section 31 are implemented with only two transistors stacked between supply voltage 26 and supply voltage 27. This implementation permits the supply voltage to be a low value and to have large variations, from as low as 3.7 volts to the upper limit permitted by the process, without effecting the constant delta $V_{BE}$ voltage across resistance 14 and therefore without effecting the reference current.

Current mirror 34 is comprised of transistor 12, which is also a part of reference current section 31, and transistor 16. Transistor 16 has a source electrode connected to supply voltage 26, and a gate electrode connected to a gate electrode of transistor 12. Unity gain buffer 39 is comprised of transistor 23 which has a source electrode connected to a drain electrode of transistor 16. Bias voltage section 33 is comprised of diode connected transistor 25 which has a gate and drain electrode connected to a drain electrode of transistor 23. Current mirror 35 is comprised of diode connected transistor 17, which also forms bias voltage section 32, and transistor 18. Transistor 17 has a gate and drain electrode connected to a source electrode of transistor 25 and to a gate electrode of transistor 18. A source electrode of transistor 17 is connected to supply voltage 27. A source electrode of transistor 18 is connected to supply voltage 27.

Current mirror 34 mirrors the reference current flowing through transistor 12 and causes an equal current to flow through transistor 16. Therefore a current equal to the reference current flows through transistors 16, 23, 25, and 17. Both transistor 17 of bias voltage section 32, and transistor 25 of bias voltage section 33 are connected to produce a gate to source voltage that is proportional to the current flowing through the transistor. Therefore, the drain of transistors 17 and 25 provide output voltages NB1 and NB2 that are proportional to the reference current. These constant output voltages NB1, NB2 can be used in other circuits to reproduce the reference current.

Current mirror 36 is comprised of transistor 10, which is also a portion of reference voltage section 30, and transistor 21. Transistor 21 has a gate electrode connected to the gate electrode of transistor 10, and a source electrode connected to supply voltage 26. Level translator 38 is comprised of diode connected transistor 22 which has a source electrode connected to a drain electrode of transistor 21. A gate electrode and drain electrode of transistor 22 are connected to a drain electrode of transistor 24 and to the feedback section. Feedback section 37 provides feedback to reference voltage section 30 and reference current section 31 from other points in the current source circuit. Feedback section 37 is composed of a feedback or reference node 20 which forms a common connection point for the drain electrode of transistor 22, the drain electrode of transistor 24, and a gate electrode of transistor 23; and a connection from reference node 20 to the base electrode of transistors 11 and 13. In the preferred embodiment, feedback section 37 includes buffer transistor 19 which reduces the loading of transistors 11 and 13 on common connection 20 to other circuit components. Circuits with less loading may omit transistor 19. In this preferred embodiment, transistor 19 has a collector electrode connected to supply terminal 27, an emitter electrode connected to the base electrodes of transistors 11 and 13, and a base electrode connected to reference node 20.

Unity gain buffer 40 is comprised of transistor 24 which has a source electrode connected to a drain electrode of transistor 18. A gate electrode of transistor 24 is connected to a gate electrode of transistor 25.

Current mirror 35 mirrors the current flowing through transistor 17, and causes an equal current to flow through transistor 18. Since a current equal to the reference current flows through transistor 17, a current equal to the reference current also flows through transistor 18 and through transistor 24. Current mirror 36 mirrors the current flowing through transistor 10 and causes an equal current to flow through transistor 21 and therefore through transistor 22. Therefore, the current flowing in reference voltage section 30 flows in transistors 21 and 22 while the reference current flows in transistors 18 and 24. These two currents are kept equal by the feedback section. The voltage at reference node 20 of feedback section 37 is supply voltage 26 minus the gate to source voltage of transistor 10 minus the base to emitter voltage of transistor 11, and in the preferred embodiment the base to emitter voltage of transistor 13. As the voltage at reference node 20 varies, the base to emitter voltages of transistor 11 and transistor 13 also vary which then varies the gate to source voltage of transistor 10. These voltage variations alter the gate to source voltage of transistor 21 until the current conducted by transistors 21 and 10 equals the current flowing through transistors 18 and 24. Therefore, feedback section 37 insures equal current flows through the reference voltage section and the reference current section.

Transistor 24 buffers transistor 18 from the voltage changes at common connection 20 of feedback section 37 by absorbing supply voltage variations across transistor 24. This buffering maintains constant drain voltage on transistor 18 thereby reducing output error by insuring current mirror 35 accurately reproduces the current flowing in transistor 17. Transistor 23 buffers the drain electrode of transistor 16 from the voltage on the drain electrode of transistor 25 by absorbing supply voltage variations across transistor 23. This buffering maintains constant drain voltage on transistor 16 thereby reducing output errors by insuring current mirror 34 accurately reproduces the reference current. Level translator 38 shifts the voltage level of feedback section 37 up to the level of the drain of transistor 21 thereby maintaining a constant voltage on the drain of transistor 21 which minimizes output error and insures current mirror 36 accurately reproduces the current flowing in transistor 10. Transistors 22 and 23 compensate for the non-ideal output impedance of transistors 16 and 21 and function to equalize the drain voltage of transistors 16 and 21 thereby further reducing errors in the bias voltage outputs.

It can be readily determined that operation at yet lower supply voltages (to as low as approximately 2.7 volts) can be achieved by removing transistors 22 and 23 with a resulting increase in output error. Transistors 24 and 25 can also be removed for operation at a lower supply voltage. Output voltage NB1 will have a slightly increased error without transistors 24 and 25, and output NB2 is eliminated.

In the preferred embodiment, transistors 11, 13, and 19 are PNP bipolar transistors. Transistors 10, 12, 16, and 21 are P-channel CMOS transistors that are all matched with equal lengths and widths. Additionally the body effect voltage is minimized for each of these P-channel transistors by connecting the well of each transistor to supply voltage 26. This implementation equally lowers each transistor's gate to source voltage. Both of these techniques are used to insure the gate to source voltage of all four transistors are equal and that equal currents will be produced by current mirrors 34, 35, and 36. P-channel transistors 22 and 23 are also matched and the well of each is connected to the source electrode thereby minimizing body effect voltage and equally reducing each of these transistor's gate to source voltage. This also helps insure equal voltages are on the drain of transistors 16 and 21 which further increases the output accuracy of current mirrors 34 and 36. The body effect voltage of N-channel CMOS transistors 17 and 18 is minimized by connecting the transistor's substrate to the source electrode thereby equally reducing each of these transistor's gate to source voltage. Lowering the gate to source voltage of all these transistors minimizes the effect of matching errors and increases the accuracy and operating range of the current source circuit.

In order to prevent the possibility of an inactive state, a conventional start-up circuit (not shown) is required to allow start-up current to flow through reference voltage section 30.

By now it should be appreciated that there has been provided a novel way to fabricate a constant current source circuit which minimizes output errors for a wide range of supply voltage variations. The limited use of stacked transistors, the use of matched transistors with low voltage body effect voltage, and the compensation provided by the feedback provides a current source circuit with minimized output error for a wide range of supply voltage variations. This current source circuit can be used to develop a predetermined reference current for use in very accurate analog to digital converters, voice conversion circuits, and other analog circuits requiring a very accurate reference current.

We claim:

1. A current source circuit having a constant output which comprises:

a diode connected first transistor having a first current electrode connected to a first supply voltage, a second current electrode and a control electrode connected to the second current electrode;

a second transistor having a first current electrode connected to the control electrode of the first transistor, a second current electrode coupled to a second supply voltage, and a control electrode;

a diode connected third transistor having a first current electrode coupled to the first supply voltage, and a second current electrode and a control electrode connected to the second current electrode;

a means for providing resistance having a first terminal coupled to the control electrode of the third transistor, and a second, terminal;

a fourth transistor having a first current electrode coupled to the second terminal of the means for providing a resistance, a second current electrode coupled to the second supply voltage, and a control electrode;

a fifth transistor having a control electrode coupled to the control electrode of the third transistor, a first current electrode coupled to the first supply voltage, and a second current electrode;

a sixth transistor having a first current electrode coupled to the second current electrode of the fifth transistor, a second current electrode, and a control electrode;

a seventh transistor having a control electrode and first current electrode coupled to the second current electrode of the sixth transistor, and a second current electrode;

an eighth transistor having a first current electrode and control electrode coupled to the second current electrode of the seventh transistor, and a second current electrode coupled to the second supply voltage;

a ninth transistor having a first current electrode coupled to the second supply voltage, a control electrode coupled to the control electrode of the eighth transistor, and a second current electrode;

a tenth transistor having a first current electrode coupled to the second current electrode of the ninth transistor, a control electrode coupled to the control electrode of the seventh transistor, and a second current electrode;

an eleventh transistor having a control electrode coupled to the control electrode of the first transistor, a first current electrode coupled to the first supply voltage, and a second current electrode;

a twelfth transistor having a first current electrode coupled to the second current electrode of the eleventh transistor, a second current electrode and a control electrode connected to the second current electrode; and a common node coupling the second current electrode of the twelfth transistor, a control electrode of the sixth transistor, the second current electrode of the tenth transistor, to the control electrodes of the second and the fourth transistor.

2. The current source circuit of claim 1 further including a bipolar transistor having a control electrode coupled to the common node, and further including the bipolar transistor having a first current electrode coupled to the second supply voltage, and a second current electrode coupled to the control electrode of the second transistor and to the control electrode of the fourth transistor.

3. The current source circuit of claim 1 wherein the second, and fourth transistors are bipolar transistors.

4. The current source circuit of claim 1 wherein at least the first, third, fifth, and eleventh transistors are P-channel MOS transistors having a connection from the first supply voltage to a well of each transistor; wherein at least the sixth and twelfth transistors are P-channel MOS transistors having a source electrode connected to the well of each transistor; and wherein at least the eighth and ninth transistors are N-channel transistors having the well of each transistor connected to the second supply voltage.

5. The current source of claim 1 wherein a connection to the drain of the seventh transistor forms a first output terminal.

6. The current source of claim 5 wherein a connection to the drain of the eighth transistor forms a second output terminal.

7. A method of utilizing a delta $V_{BE}$ technique to generate a constant output having a wide operating range which comprises:

generating a reference voltage with a reference voltage circuit;

generating a reference current which is proportional to the reference voltage;

forming a first current mirror wherein a portion is formed as a portion of a reference current circuit;

forming a second current mirror wherein a portion forms a first bias voltage circuit;

providing feedback to the reference voltage circuit and to the reference current circuit wherein the feedback is obtained from a common connection point;

coupling a second bias voltage circuit to the first bias voltage circuit;

buffering the first current mirror from the second bias voltage circuit with a first unity gain buffer which is connected in series between them and which is coupled to the common connection;

buffering the second current mirror from the common connection with a second unity gain buffer which is connected in series between the second current mirror and the common connection;

forming a third current mirror wherein a portion is formed as a portion of the reference voltage circuit; and coupling a voltage level translator in series between the common connection point and the third current mirror.

8. A method of generating a constant output which comprises:

generating a reference voltage with a reference voltage circuit;

generating a reference current which is proportional to the reference voltage;

establishing a first current which is substantially equal to the reference current;

using the first current to establish a second current which is substantially equal to the first current, and also using the first current to establish a first and a second output;

establishing a third current which is substantially equal to a current flowing in the reference voltage circuit; and establishing a feedback signal at a reference node by coupling the second current to the third current wherein the feedback signal is used in generating the reference voltage and in generating the reference current.

9. A CMOS current source circuit utilizing a delta $V_{BE}$ reference technique and having a wide operating voltage range which comprises:

means for providing a reference voltage;

means for providing a reference current that is proportional to the reference voltage;

means for providing a first current mirror, wherein a portion is formed as a portion of the means for providing a reference current, whereby current flowing through the first current mirror is equal to the reference current;

means for providing a first bias voltage wherein the same current flows through the means for providing a first bias voltage and through the first current mirror thereby providing an output from the means for providing a first bias voltage that is proportional to the reference current;

means for providing a second current mirror, wherein a portion forms the means for providing a second bias voltage, having a series connection to the means for providing a first bias voltage whereby the same current flows through the first current mirror, through the means for providing a first bias voltage, through the second current mirror, and through the means for providing a second bias voltage thereby creating an output from the means for providing a second bias voltage that is proportional to the reference current;

means for providing a third current mirror, wherein a portion is formed as a portion of the means for providing a reference voltage, whereby a current equal to the current flowing in the means for providing the reference voltage flows in the third current mirror;

means for providing a level translator whereby the current flowing in the third current mirror also flows through the level translator and the second current mirror; and a common connection coupled to the level translator and wherein the common connection is coupled to the means for providing a reference voltage and to the means for providing a reference current.

10. The CMOS current source of claim 9 wherein the means for providing a reference voltage includes a diode connected first MOS transistor of a first conductivity type having a first current electrode coupled to a first supply voltage, a control electrode and a second current electrode coupled to a first current electrode of a first bipolar transistor of the first conductivity type and further includes a second current electrode of the first bipolar transistor coupled to a second supply voltage, and a control electrode.

11. The CMOS current source of claim 10 wherein the means for providing a reference current includes a diode connected second MOS transistor of the first conductivity type having a first current electrode coupled to the first supply voltage, a control electrode and a second current electrode coupled to a first terminal of a means of providing resistance and further includes a second bipolar transistor of the first conductivity type having a first current electrode coupled to a second terminal of the means for providing resistance, a second current electrode coupled to the second supply voltage, and a control electrode coupled to the control electrode of the first bipolar transistor.

12. The CMOS current source of claim 11 wherein the means for providing a first current mirror includes the diode connected second MOS transistor and further includes a third MOS transistor of the first conductivity type having a control electrode coupled to the control electrode of the second MOS transistor, a first current electrode coupled to the first supply voltage, and a second current electrode.

13. The CMOS current source of claim 12 wherein the means for providing a first bias voltage includes a diode connected fourth MOS transistor of a second conductivity type having a control electrode and first current electrode coupled to the second current electrode of the third MOS transistor and to a first bias voltage output terminal, and a second current electrode.

14. The CMOS current source of claim 13 wherein the means for providing a second current mirror includes the means for providing a second bias voltage as a diode connected fifth MOS transistor of the second conductivity type having a first current electrode and control electrode coupled to the second current electrode of the fourth MOS transistor, to a second bias voltage output terminal, and to a control electrode of a sixth MOS transistor of the second conductivity type and further includes the fifth MOS transistor having a second current electrode coupled to the second supply voltage and the sixth MOS transistor having a first current electrode coupled to the second supply voltage, and a second current electrode.

15. The CMOS current source of claim 14 wherein the means for providing a third current mirror includes the diode connected first MOS transistor and further includes a seventh MOS transistor of the first conductivity type having a control electrode coupled to the control electrode of the first MOS transistor, a first current electrode coupled to the first supply voltage, and a second current electrode.

16. The CMOS current source of claim 15 wherein the means for providing a level translator includes a diode connected eighth MOS transistor of the first conductivity type having a first current electrode coupled to the second current electrode of the seventh MOS transistor, and a control electrode coupled to both a second current electrode and to the common connection.

17. The CMOS current source of claim 16 wherein a common connection includes a third bipolar transistor of the first conductivity type having a control electrode coupled to the second current electrode of the eighth MOS transistor, and the second current electrode of the sixth MOS transistor and further includes the third bipolar transistor having a first current electrode coupled to the second supply voltage, and a second current electrode coupled to the control electrode of the first bipolar transistor and the control electrode of the second bipolar transistor.

* * * * *